US011377811B2

(12) United States Patent
Regler

(10) Patent No.: US 11,377,811 B2
(45) Date of Patent: Jul. 5, 2022

(54) FOUNDATION ENGINEERING METHOD AND CONSTRUCTION APPARATUS FOR PRODUCING A COLUMNAR STRUCTURE IN THE GROUND

(71) Applicant: BAUER Spezialtiefbau GmbH, Schrobenhausen (DE)

(72) Inventor: Hans Regler, Schrobenhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 64 days.

(21) Appl. No.: 17/055,766

(22) PCT Filed: Apr. 17, 2019

(86) PCT No.: PCT/EP2019/059948
§ 371 (c)(1),
(2) Date: Nov. 16, 2020

(87) PCT Pub. No.: WO2019/219320
PCT Pub. Date: Nov. 21, 2019

(65) Prior Publication Data

US 2021/0230826 A1 Jul. 29, 2021

(30) Foreign Application Priority Data

May 18, 2018 (EP) ..... 18173174

(51) Int. Cl.
*E02D 13/06* (2006.01)
*E02D 3/12* (2006.01)
*E02D 5/46* (2006.01)

(52) U.S. Cl.
CPC ..... *E02D 13/06* (2013.01); *E02D 3/12* (2013.01); *E02D 5/46* (2013.01);
(Continued)

(58) Field of Classification Search
CPC combination set(s) only.
See application file for complete search history.

(56) References Cited

FOREIGN PATENT DOCUMENTS

CN 107503733 A 12/2017
DE 19521639 A1 5/1996
(Continued)

OTHER PUBLICATIONS

International Search Report issued in PCT/EP2019/059948; dated Jun. 4, 2019.
(Continued)

*Primary Examiner* — Kyle Armstrong
(74) *Attorney, Agent, or Firm* — Studebaker & Brackett PC

(57) ABSTRACT

The invention relates to a foundation engineering method and a construction apparatus for producing a columnar structure in the ground, in which a foundation engineering tool is driven in a rotating manner about an axis of rotation and introduced with a feeding motion into a ground, wherein the columnar structure is produced in the ground. According to the invention it is provided that during the production of the columnar structure a rotating motion and a feeding motion of the foundation engineering tool are recorded over time and forwarded to an evaluation unit, in that by means of a sensor means at least one further processing parameter is recorded over time during the production of the columnar structure in the ground and is forwarded to the evaluation unit and in that by the evaluation unit a three-dimensional model of the columnar structure is produced and displayed.

11 Claims, 3 Drawing Sheets

Figure 1:
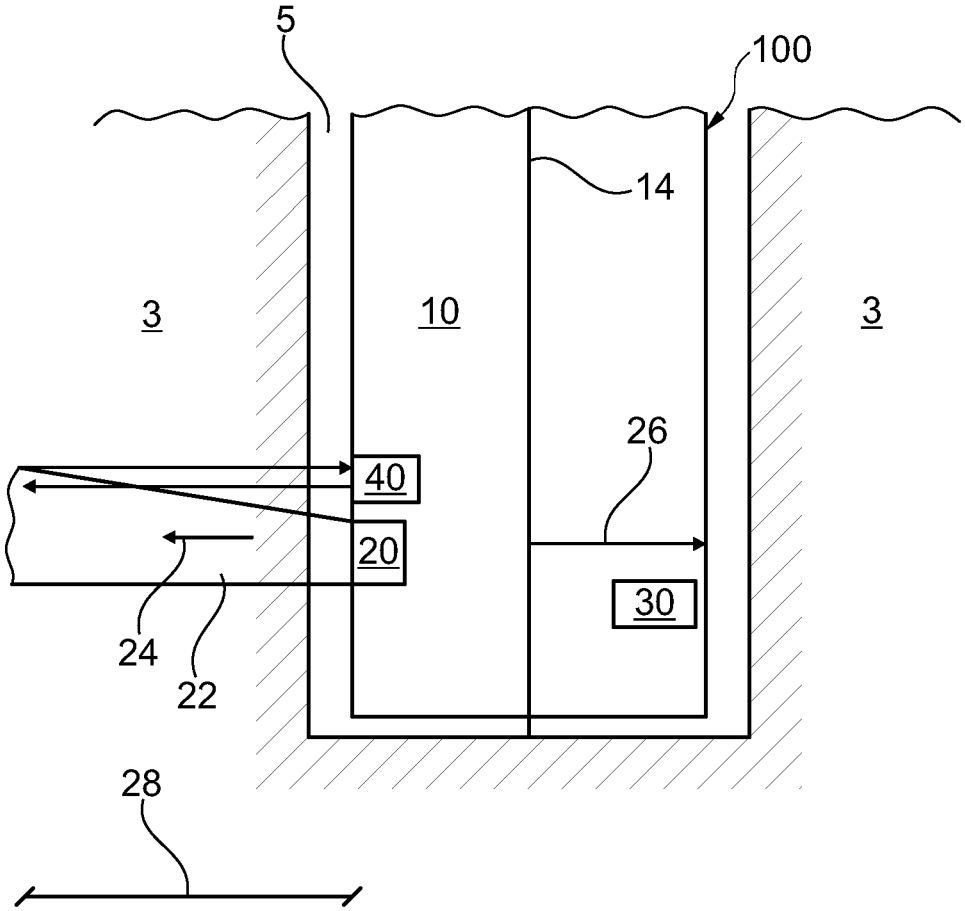

(52) U.S. Cl.
CPC ..... *E02D 2200/1685* (2013.01); *E02D 2250/003* (2013.01); *E02D 2600/10* (2013.01)

(56) References Cited

FOREIGN PATENT DOCUMENTS

| | | | |
|---|---|---|---|
| DE | 19622282 | C1 | 8/1997 |
| DE | 19834731 | C1 | 8/1999 |
| EP | 2806070 | B1 | 9/2015 |
| GB | 2328700 | A | 3/1999 |
| JP | H08-27463 | A | 1/1996 |
| JP | H11-20997 | A | 1/1999 |

OTHER PUBLICATIONS

An Office Action mailed by China National Intellectual Property Administration dated Nov. 3, 2021, which corresponds to Chinese Patent Application No. 201980033420.0 and is related to U.S. Appl. No. 17/055,766; with English language translation.

FOUNDATION ENGINEERING METHOD AND CONSTRUCTION APPARATUS FOR PRODUCING A COLUMNAR STRUCTURE IN THE GROUND

The invention relates to a foundation engineering method for producing a columnar structure in the ground, in which a foundation engineering tool is driven in a rotating manner about an axis of rotation and introduced with a feeding motion into a ground, wherein the columnar structure is produced in the ground, in accordance with the preamble of claim 1.

The invention further relates to a construction apparatus for producing a columnar structure in the ground, having a foundation engineering tool which can be driven in a rotating manner about an axis of rotation by means of a rotary drive and can be displaced in a feeding direction into the ground by means of a feed drive, at least one recording means for recording a rotating motion of the foundation engineering tool and a feeding motion and at least one sensor means for recording at least one further processing parameter, in accordance with the preamble of claim 10.

A generic foundation engineering method and a generic construction apparatus can be taken from EP 2 806 070 B1. In this known method a high-pressure injection body is produced in the ground by means of a drill rod which has an outlet for ejecting an injection medium into the ground. On the drill rod a gyroscopic measuring means is provided for recording a direction of movement of at least a part of the drill rod brought about by the ejection of the injection medium. An electronic evaluation means renders it possible to assign ascertained depths of propagation of the injection medium to the current issuing direction.

By rotating the drill rod with the outlet the injection medium is introduced radially around the drill rod into the ground. It is possible to initially erode the ground by a high-pressure water jet and to subsequently eject the injection medium into the surrounding area consisting of eroded ground and water. By raising the drill rod with the outlet an approximately cylindrical high-pressure injection body (HPI-body) can be formed.

HPI-bodies or HPI-columns are used for various purposes. In particular, a building ground can be consolidated or sealed off against the ingress of ground water. When excavation pits are secured different types of walls, such as pile walls and sheet pile walls, can be connected to each other by way of HPI-bodies.

Basically, the injection medium can be any type of fluid or any type of liquid or suspension, to which solid matter can also be added. For example, a cement suspension, chemicals or synthetic resins can be used.

In order that an HPI-body provides the desired sealing or stability the actual dimensions of the HPI-body produced have to correspond to an adequate degree to desired dimensions. This is of particular importance if several HPI-bodies located next to each other in the ground are intended to provide a sealing. In this case, there may be no free space remaining between the HPI-bodies.

However, the precise dimensions of an HPI-body, especially in the radial direction with respect to the drill rod, can vary depending on the ground. For instance, an obstacle in the ground can inhibit penetration of the injection medium. As a consequence, a produced HPI-body normally does not have a precise cylindrical shape. In fact, its radial extension depends on the depth and the azimuth angle. The latter indicates a direction in a plane located perpendicularly to the drilling axis.

Nonetheless, in order to provide a sealing effect with HPI-bodies, these are usually produced with an overlap in the ground. The overlap is chosen the larger the more uncertain the knowledge of the dimensions of the HPI-bodies is. Hence, the number of HPI-bodies to be constructed increases, resulting in a greater amount of time needed and higher costs.

To be able to keep the overlap between adjacent HPI-bodies to a minimum, use is made of measuring means. In DE 195 21 639 A1 the construction of an HPI-body is monitored by a geophone. This is driven into the ground whilst being located at a distance to the drill rod. By recording ground vibrations the range can be estimated, up to which the injection medium is ejected. However, the driving-in of a geophone constitutes an additional workload that leads to an increase in the amount of time needed and human resources required. Moreover, the precision that can be achieved thereby is limited.

By comparison, in the case of a generic device and a generic method, in which the measuring means is fixed on the drill rod, advantages are achieved. The operation of such a measuring means practically does not involve any additional workload. Such a device and such a method are described in DE 196 22 282 C1 for example. In this document, the measuring means comprises a sound transmitter and receiver. The emitted sound is reverberated on a boundary surface of the borehole, in particular to an injection body. From the running time of the sound signal the radial extension of the borehole or the depth of propagation of the injection medium can then be determined.

Another device and another method are known from DE 198 34 731 C1. In this document, the measuring means comprises a coil with a measuring rope that can be unwound. By recording the degree of unwinding of the measuring rope conclusions can be drawn as to the radial dimensions of the high-pressure injection body.

Although the dimensions of the injection body can thus be determined the evaluation and interpretation of the measurement data require not an inconsiderable effort. However, it is desirable that the three-dimensional structure produced in the ground is determined with particular precision and that an efficient checking of the processing result is rendered possible.

An object of the invention is to provide a method and a construction apparatus for producing a three-dimensional structure in the ground, with which the produced structure can be ascertained and checked in a particularly efficient manner.

This object is achieved by a foundation engineering method having the features of claim 1 and by a construction apparatus having the features of claim 10.

Preferred variants of the invention are subject of the dependent claims.

The method according to the invention is characterized in that during the production of the columnar structure a rotating motion and a feeding motion of the foundation engineering tool are recorded over time and forwarded to an evaluation unit, in that by means of a sensor means at least one further processing parameter is recorded over time during the production of the columnar structure in the ground and is forwarded to the evaluation unit and in that by the evaluation unit a three-dimensional model of the columnar structure is produced and displayed.

One aspect of the invention resides in the fact that in a foundation engineering method used for the production of a columnar structure in the ground certain measurement values are recorded over time and from this a three-dimensional model of the produced columnar structure is formed and displayed in the most illustrative way possible. The produced three-dimensional model of the columnar structure does not have to be a true-to-scale model of the columnar structure actually produced in the ground, such as a foundation pile. Of importance is the fact that the produced three-dimensional model can illustrate a correct execution of the foundation engineering method and possible defects of the produced structure. For this purpose, a rotating motion of the rotating foundation engineering tool and at the same time a feeding motion of the foundation engineering tool are recorded over time during the production process.

In addition, at least one further processing parameter relevant for the production of the columnar structure in the ground is recorded over time. From this, an illustrative three-dimensional pillar model of the columnar structure can then be produced by the evaluation unit and directly displayed on a display means at an operating or monitoring station, e.g. located directly in the construction apparatus.

In this way, an indication can immediately be displayed to a machine operator, for example, as to whether the columnar structure produced in the ground shows an undesirable defect. The immediate display enables the machine operator to directly carry out a post-processing with the foundation engineering tool, in particular as long as e.g. an introduced cement suspension has not yet hardened. Such a prompt correction of defects can be implemented considerably easier and more cost-effectively than if a defect is only noticed when the structure is completed and has hardened in the ground.

Basically, any type of columnar structure can be produced in the ground, such as an HPI-element for an injection anchor or a limestone or gravel column. According to an embodiment of the invention it is especially preferred that as columnar structure a foundation pile is produced in the ground. The foundation pile can be produced through material-removing drilling or through displacement drilling, in which case a hardenable suspension is led into the produced borehole.

According to a further development of the invention it is particularly advantageous that as foundation engineering tool a drilling tool with injection opening or an injection lance is used for injecting a hardenable suspension and in that a hardenable suspension is introduced into the ground by the rotating foundation engineering tool in order to produce the columnar structure in the ground. By way of such rotating drilling tools it is possible to simultaneously produce the borehole and, in the same or in a subsequent working process, introduce the hardenable suspension. During this introduction the drilling tool with the injection opening performs a spiral motion which results from an overlaying of a rotating motion and a feeding motion.

As further operating parameter any parameter can be recorded during the production of the columnar structure in the ground that allows an assessment on the structure produced in the ground. In this connection it is especially advantageous that as at least one further operating parameter an injection pressure, a pump pressure, an injection volume, a temperature, a tool deflection and/or a measured sound value is recorded. These parameters can be recorded individually or also in any combination with each other and used for the production of the three-dimensional model. A particularly good assessment on the introduction of a hardenable suspension can be made by measuring a tool deflection or a sound, as indicated, for example, in the printed publications EP 2 896 070 B1 and DE 196 22 282 C1 stated in the introductory part of the description and as is also generally known to an average person skilled in the art.

According to a further method variant of the invention it is preferred that by the evaluation unit a helical time axis is formed depending on the rotating motion and feeding motion recorded over time and in that the at least one processing parameter recorded over time is assigned to the helical time axis in order to form the three-dimensional model. For this purpose, the evaluation unit combines the ascertained rotating motion and the ascertained feeding motion such that not a linear straight time axis but a helical time axis is formed. In this, the center axis of the helical shape can preferably be a measure of the distance covered, i.e. the depth in the ground. If the at least one further parameter is then plotted over the helical time axis, this results in an illustrative display that permits direct comparisons to the columnar structure actually produced in the ground and, in particular, renders it easy to identify deviations and defects.

In this connection, it is especially advantageous that following assignment of the at least one processing parameter to the helical time axis the three-dimensional model of the columnar structure is formed through interpolation by the evaluation unit. In doing so, the areas missing between the helical turns are determined mathematically through corresponding interpolation of the operating parameters lying opposite in the axial direction onto the adjoining turns of the helical time axis. By preference, a linear interpolation is provided in this case. In this way, it is relatively easy to produce a spatial, columnar model from a linear recording of a parameter.

Furthermore, a preferred method variant resides in the fact that the rotating motion is directly recorded on a rotary drive or by a rotational-speed measuring element on the foundation engineering tool. The rotational-speed measuring element can in particular be a rotational-speed counter. Alternatively, the rotating motion can also be directly taken by a rotational-speed counter on the rotary drive.

A measurement of the feeding motion can basically be carried out in any suitable way. It is particularly preferred that the feeding motion is directly recorded on a feed drive or by a distance measuring element on the foundation engineering tool.

According to a further development of the invention a particularly efficient foundation engineering method is achieved in that in the evaluation unit a three-dimensional target model is stored for the columnar structure to be produced in the ground, in that by the evaluation unit the ascertained three-dimensional model for the columnar structure is compared as an actual model with the target model and in that on a display means deviations between the target model and the actual model are displayed. These deviations can be considered as defects, especially if the actual model does not correspond in its external circumference to the target model with its external circumference. These defects can preferably be shown on a color display in another color, e.g. in red color. In this way, a defect or an insufficient formation of the columnar structure in the ground is directly visible to a machine operator. If the longitudinal axis of the columnar model corresponds to a vertical axis of the columnar structure in the ground, it is also possible to directly establish the depth position, in which a defect is present in the columnar structure produced in the ground. Hence, this defect can be immediately eliminated by the machine operator through post-processing.

The construction apparatus according to the invention is characterized in that an evaluation unit is provided which is connected to the at least one recording means and the sensor means, wherein the evaluation unit is designed to produce a three-dimensional model of the columnar structure on the basis of the recorded data, and in that a display means is provided, with which the produced three-dimensional model of the columnar structure can be displayed.

By way of the drilling apparatus according to the invention the previously described method according to the invention can be carried out in particular. The advantages described beforehand are achieved thereby.

The construction apparatus can in particular be a drilling apparatus for producing a foundation pile in the ground or an injection anchor.

According to a further development of the invention it is especially preferred that the foundation engineering tool is a drilling tool with injection opening or an injection lance for injecting a hardenable suspension. As further processing parameter a measurement value is preferably used which represents a measure of the introduced hardenable suspension per time and location.

Another advantageous embodiment of the drilling apparatus according to the invention resides in the fact that a rotational-speed measuring element is provided, with which a rotating motion of the foundation engineering tool can be recorded over time, and/or in that a distance measuring element is provided, with which a displacement distance of the foundation engineering tool can be recorded over time.

Figure 2:
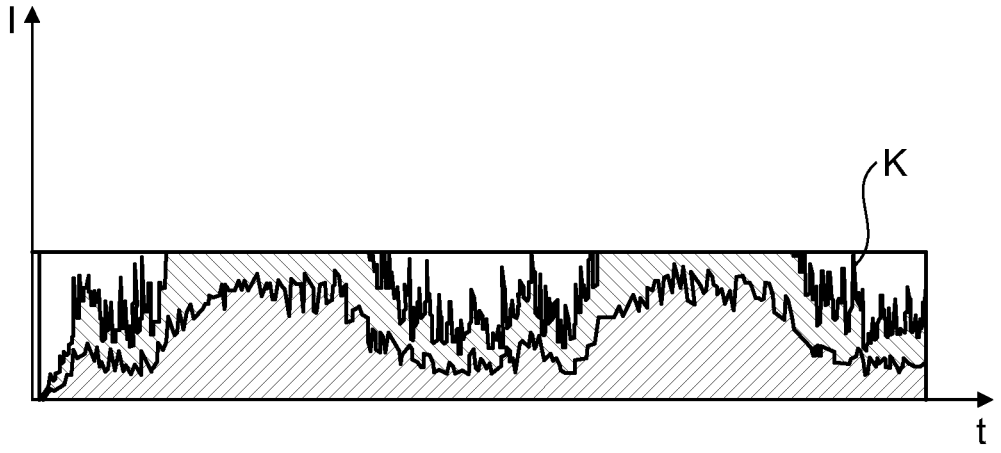
Figure 3:
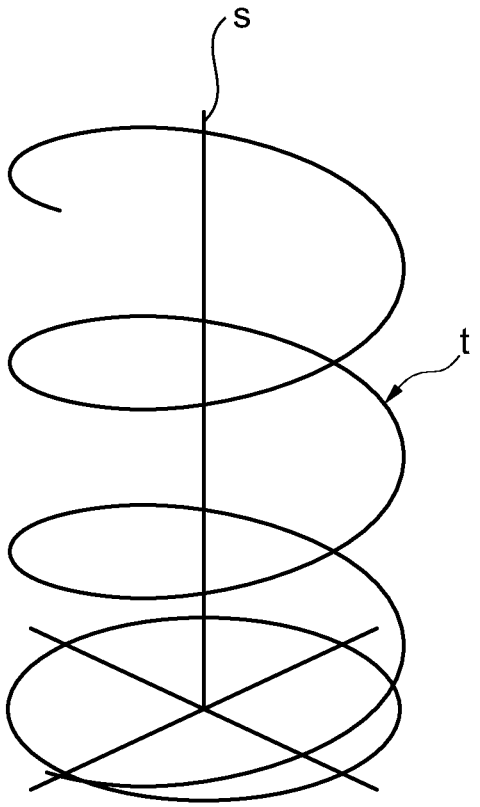
Figure 4:
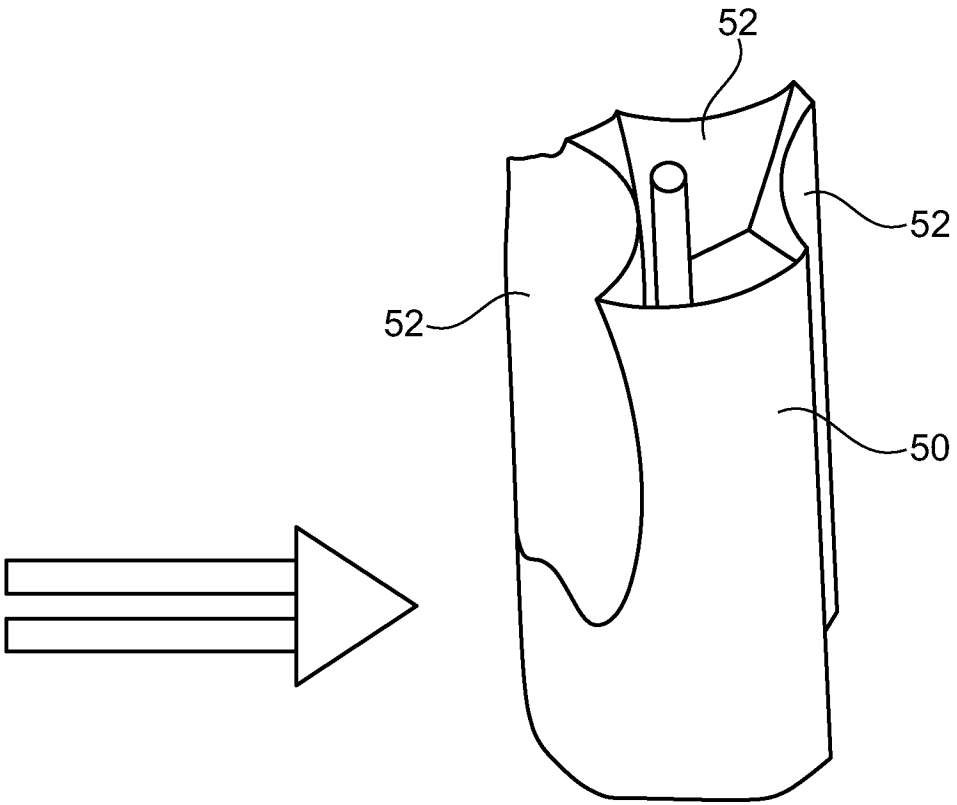
Figure 4:
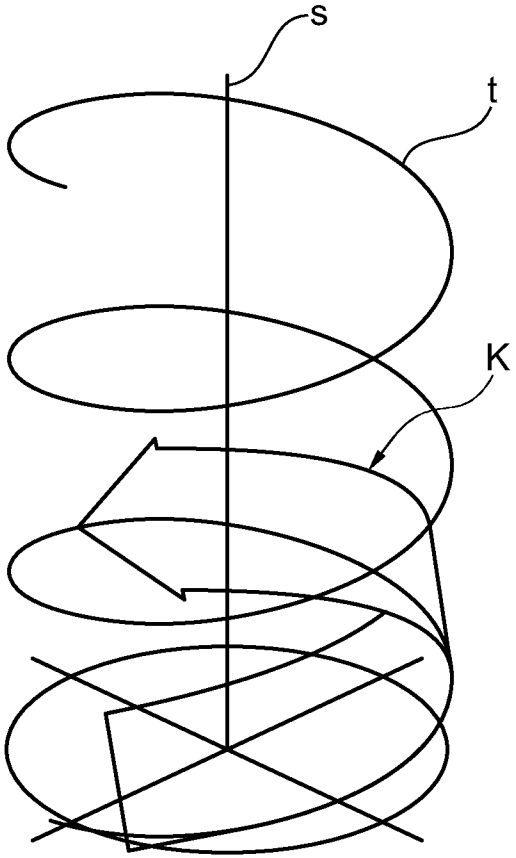

The invention will be explained hereinafter by way of preferred embodiments illustrated schematically in the drawings, wherein show:

FIG. 1 a section of a construction apparatus, illustrated in a highly schematic manner, during the production of a columnar structure in the ground;

FIG. 2 a measurement data example of a data curve of a measured sound intensity over time during the production of a columnar structure in the ground according to the arrangement of FIG. 1;

FIG. 3 a helical illustration of the time axis t over the distance s, in which case a 360° segment of the helix corresponds to a rotation of the foundation engineering tool according to FIG. 1; and FIG. 4 an illustrative depiction of the schematic transfer of a raw data curve according to FIG. 2 to the helical time axis and the schematic ascertaining of a three-dimensional columnar model therefrom.

FIG. 1 schematically shows an embodiment of a construction apparatus 100 according to the invention for the production of a columnar structure 32 in a ground 3.

As a foundation engineering tool 10 the construction apparatus 100 comprises a drill rod, with which a borehole 5, illustrated in section in FIG. 1, can be produced. On the rod-shaped foundation engineering tool 10 an injection opening 20 is designed. Through this an injection medium 22 can be ejected from the foundation engineering tool 10 into the ground 3. Together with the foundation engineering tool 10 or also independently thereof the injection opening 20 is rotatable about an axis of rotation 14, also referred to as drilling axis. Through this a columnar structure 32 is produced which surrounds the bar-shaped foundation engineering tool 10.

The ejected injection medium 22 penetrates up to a depth of propagation 28. The depth of propagation 28 is a radial distance that can be determined from the injection opening 20 or from the axis of rotation 14. Due to obstacles in the ground the extent of the depth of propagation 28 can depend on the azimuth angle around the axis of rotation 14 and/or on the height of the injection opening 20 along the axis of rotation 14.

To measure the depth of propagation 28 a sensor means 40 is arranged in a co-rotating manner on the foundation engineering tool 10. This receives a measuring signal, for instance a sound signal. As sound signal the injection noise can be used or a transmitter can be employed to emit an acoustic signal, the reflections of which are measured as a sound signal by the sensor means 40. The signal can in particular be reverberated on a boundary surface between the injection medium 22 and the ground 3.

For the ascertained depth of propagation 28 the related azimuthal direction is also ascertained that indicates a rotational position of the injection opening 20 around the axis of rotation 14. For this purpose, gyroscopic measuring means 30 can be provided on the bar-shaped foundation engineering tool 10. These record a direction of movement 26 of at least a part of the foundation engineering tool 10. This movement is caused by the ejection of the injection medium 22. Therefore, an ejecting direction 24 and the direction of movement 26 of the drill rod 10 are directly opposed to each other. This enables an electronic evaluation unit to calculate different ejecting or issuing directions 24 of the injection opening 20 from the measurement values of the gyroscopic measuring means 30. A correct rotational position can also be ascertained and recorded by recording the angle of rotation or a rotational speed on the basis of an initial rotational position.

By preference, for a 360° rotation of the injection opening 20 several different issuing directions 24 are recorded successively with the gyroscopic measuring means 30 and the related depths of propagation 28 are forwarded to the evaluation unit. In this way, the dimensions of the columnar structure 32 formed in the ground can be ascertained at a high precision.

In FIG. 2 a possible raw data curve is shown which is ascertained through sound measurement with the arrangement of FIG. 2. FIG. 2 shows, along a time axis t, the sound intensity I measured periodically per revolution which represents a measure of the depth of propagation of the injection medium 22 and therefore a measure of the external shape of the columnar structure 32 produced in the ground. The columnar structure 32 can in particular be a foundation pile in the ground 3.

According to the invention the raw data curve which is of little explicitness at first hand is transferred to a helical time axis t illustrated schematically in FIG. 3. In this, the longitudinal axis s of the helical shape is a measure of the distance covered or the depth of the foundation engineering tool 10 in the ground 3. A 360° winding of the helical shape represents a 360° rotation of the foundation engineering tool 10 in operation, in which case the related axial distance s corresponds to a feeding motion of the foundation engineering tool 10 per revolution.

The raw data curve according to FIG. 2, together with the sound value as a further processing parameter, can be transferred to the helical time axis t thus formed according to FIG. 3. From this, a columnar model 50 can be produced through simple mathematical interpolation according to FIG. 4 and displayed on a display means preferably located on the construction apparatus 100. The values for the sound intensity I can be plotted in a radial direction with respect to the longitudinal axis s so that a substantially cylindrical columnar shape is obtained. Due to deviations in the sound intensity it is possible to directly identify deviations in the columnar model 50 as dents 52 or dints and thus as possible defects in the produced foundation pile.

The invention claimed is:

1. A foundation engineering method for producing a columnar structure in the ground, in which a foundation engineering tool is driven in a rotating manner about an axis of rotation and introduced with a feeding motion into a ground, wherein the columnar structure is produced in the ground, wherein during the production of the columnar structure a rotating motion and a feeding motion of the foundation engineering tool are recorded over time and forwarded to an evaluation unit, by means of a sensor means at least one further processing parameter is recorded over the time during the production of the columnar structure in the ground and is forwarded to the evaluation unit and in that by the evaluation unit a three-dimensional model of the columnar structure is produced and displayed, wherein by the evaluation unit a helical time axis is formed depending on the rotating motion and feeding motion recorded over time and in that the at least one processing parameter recorded over time is assigned to the helical time axis in order to form the three-dimensional model.

2. The foundation engineering method according to claim 1, wherein as columnar structure a foundation pile is produced in the ground.

3. The foundation engineering method according to claim 1, wherein as foundation engineering tool a drilling tool with injection opening or an injection lance is used for injecting a hardenable suspension and a hardenable suspension is introduced into the ground by the rotating foundation engineering tool in order to produce the columnar structure.

4. The foundation engineering method according to claim 1, wherein as at least one further operating parameter an injection pressure, a pump pressure, an injection volume, a temperature, a tool deflection and/or a measured sound value is recorded.

5. The foundation engineering method according to claim 1, wherein following assignment of the at least one processing parameter to the helical time axis the three-dimensional model of the columnar structure is formed through interpolation by the evaluation unit.

6. The foundation engineering method according to claim 1, wherein the rotating motion is directly recorded on a rotary drive or by a rotational-speed measuring element on the foundation engineering tool.

7. The foundation engineering method according to claim 1, wherein the feeding motion is directly recorded on a feed drive or by a distance measuring element on the foundation engineering tool.

8. The foundation engineering method according to claim 1, wherein in the evaluation unit a three-dimensional target model is stored for the columnar structure to be produced in the ground, by the evaluation unit the ascertained three-dimensional model for the columnar structure is compared as an actual model with the target model and on a display means deviations between the target model and the actual model are displayed.

9. A construction apparatus for producing a columnar structure in the ground, in particular using a foundation engineering method according to claim 1, having a foundation engineering tool which can be driven in a rotating manner about an axis of rotation by means of a rotary drive and can be displaced in a feeding direction into the ground by means of a feed drive, at least one recording means for recording a rotating motion of the foundation engineering tool and a feeding motion over time and at least one sensor means for recording at least one further processing parameter, wherein an evaluation unit is provided which is connected to the at least one recording means and the sensor means, wherein the evaluation unit is designed to produce a three-dimensional model of the columnar structure on the basis of the recorded data, and a display means is provided, with which the produced three-dimensional model of the columnar structure can be displayed.

10. The construction apparatus according to claim 9, wherein the foundation engineering tool is a drilling tool with injection opening or an injection lance for injecting a hardenable suspension.

11. The drilling apparatus according to claim 9, wherein a rotational-speed measuring element is provided, with which a rotating motion of the foundation engineering tool can be recorded over time, and/or a distance measuring element is provided, with which a displacement distance of the foundation engineering tool can be recorded over time.

* * * * *